US005417581A

United States Patent [19]

Dechelette et al.

[11] Patent Number: 5,417,581

[45] Date of Patent: May 23, 1995

[54] FLAT INSULATION DISPLACEMENT TERMINAL FOR ELECTRICAL CONNECTORS

[75] Inventors: Helen Dechelette, Wissous; Jerome Tamsson, Paris; Patrick Dechelette, Le Plessis Robinson, all of France

[73] Assignee: Molex Incorporated, Lisle, Ill.

[21] Appl. No.: 280,897

[22] Filed: Jul. 27, 1994

[30] Foreign Application Priority Data

Sep. 18, 1993 [EP] European Pat. Off. ..... 93115041

[51] Int. Cl.[6] ..... H01R 4/24; H01R 13/00

[52] U.S. Cl. ..... 439/393; 439/404; 439/417; 439/421

[58] Field of Search ..... 439/417, 421, 403, 404, 439/393, 401, 422, 392

[56] References Cited

U.S. PATENT DOCUMENTS

| | | | |
|---|---|---|---|
| 3,825,881 | 7/1974 | Wigby | 439/422 |
| 3,881,796 | 5/1975 | Saunders | 439/422 |
| 3,932,018 | 1/1976 | Parsons et al. | 439/422 |
| 3,937,549 | 2/1976 | Hughes | 439/401 |
| 4,258,973 | 3/1981 | Reynolds et al. | 439/392 |
| 4,512,619 | 4/1985 | Dechelette | 439/427 |
| 4,522,460 | 6/1985 | Beck et al. | 439/404 |
| 4,752,237 | 6/1988 | Mixon, Jr. | 439/393 |
| 4,790,771 | 12/1988 | Kleiner | 439/421 |
| 4,946,406 | 8/1990 | Lane et al. | 439/417 |
| 5,125,851 | 6/1992 | Peterson et al. | 439/421 |

*Primary Examiner*—William Briggs
*Attorney, Agent, or Firm*—A. A. Tirva

[57] ABSTRACT

An electrical connector includes a dielectric housing having a terminal-receiving passageway. An insulation displacement terminal is received in the passageway for terminating an insulated wire extending into the passageway. The wire includes an electrical conductor with a sheath of insulation thereabout. The terminal includes a terminating section deflectable for displacing the insulation and engaging the conductor. The terminating section is generally flat in a plane coincident with the longitudinal axis of the insulated wire. At least a portion of the terminating section is deflectable upon the application of a force on the terminal generally parallel to the longitudinal axis. The terminating section is configured to be permanently deformed when deflected into insulation-displacing condition with the insulated wire. The invention also is directed to such a terminal, per se.

10 Claims, 5 Drawing Sheets

FLAT INSULATION DISPLACEMENT TERMINAL FOR ELECTRICAL CONNECTORS

FIELD OF THE INVENTION

This invention generally relates to the art of electrical connectors and, particularly, to a flat terminal for insulation displacement terminating an electrical cable or wire.

BACKGROUND OF THE INVENTION

Electrical connectors have become widely accepted as a preferred means for interconnecting the circuitry components of electrically operated products and equipment. In such applications, providing for easy connection and disconnection of cable or wire through the use of connectors permits convenience of assembly and maintenance as well as versatility in design.

Connectors in current use are of diverse construction. However, a common arrangement includes a dielectric housing fitted with a plurality of stamped and formed conductive terminals to which insulated multiconductor cable or wiring may be electrically connected. Numerous terminal configurations likewise are available, suited to the specific requirement of the application. A preferred terminal in many applications is one which has the capability of establishing electrical contact with the conductors of the cable by displacement of the insulative coating of the conductors, obviating the need to perform the separate step of stripping the insulative coating.

A wide variety of insulation displacement terminals are known in the art. Generally, these terminals provide a narrow slot which receives an insulation covered wire, severs the insulation covering of the wire in the process, and establishes, automatically, an electrical connection between the terminal and the central core of the wire. This is contrasted with the self-piercing type of terminals which usually have sections in the form of teeth that pierce the insulation and engage the metallic core when the terminal is clinched or secured to the wire. When piercing the insulation, the teeth, in essence, also displace the insulation in order to engage the core of the wire.

One type of self-piercing terminal is a flat, stamped metal terminal commonly used to terminate electrical wires on a low pitch spacing, such as in a Western Electric Company modular phone plug, as is shown in U.S. Pat. No. 3,954,320, dated May 4, 1976. Such terminals have been used primarily with electrical wires having stranded conductive cores. The terminals require terminating forces applied normal to the longitudinal axis of the insulated wire, and the connector relies on the dielectric or plastic housing to maintain contact pressure on the terminals after termination. Such flat terminal connectors cause problems in many applications because the terminating forces must be applied transversely of the length of the insulated wires, which is quite limiting and is particularly limiting where multiple rows of circuit connections are desired.

The present invention is directed to providing a flat, insulation piercing type terminal which is terminated by the application of a force generally parallel to the axis of the insulated wire. The terminal of the invention is deformed during the termination process to maintain contact pressure after termination so as not to rely on the connector housing to maintain constant pressure, and the terminal is equally applicable with solid or stranded conductive cores of the insulated wire.

SUMMARY OF THE INVENTION

An object, therefore, of the invention is to provide a new and improved insulation displacement electrical connector and terminal therefor, wherein the terminal or at least the terminating section of the terminal is flat.

In the exemplary embodiment of the invention, an electrical connector includes a dielectric housing having at least one terminal-receiving passageway. An insulation displacement terminal is received in the passageway for terminating an insulated wire extending into the passageway. The wire includes an electrical conductor with a sheath of insulation thereabout. The terminal includes a terminating section deflectable for displacing the insulation and engaging the conductor.

According to one aspect of the invention, the terminating section of the terminal is generally flat in a plane coincident with the longitudinal axis of the insulated wire. At least a portion of the terminating section is deflectable upon the application of a force on the terminal generally parallel to the longitudinal axis. According to another aspect of the invention, the terminal, or at least a portion thereof, is permanently deformable into an insulation-displacing condition with the insulated wire.

As disclosed herein, the terminating section of the terminal includes a fixed portion and a deflectable portion defining a mouth therebetween for accepting the insulated wire. At least one of the portions of the terminating section include inwardly directed insulation displacing teeth.

In one embodiment of the invention, the dielectric housing is a two-part housing including a base part and a cover part. The base part mounts the terminal, and the cover part engages the terminal for deflecting the terminating section in response to relative movement between the housing parts generally parallel to the longitudinal axis of the insulated wire. The cover part includes a wire-receiving passage aligned with the terminal-receiving passageway. In another embodiment of the invention, a one-piece housing mounts the terminal, and a separate tool terminates the terminal.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
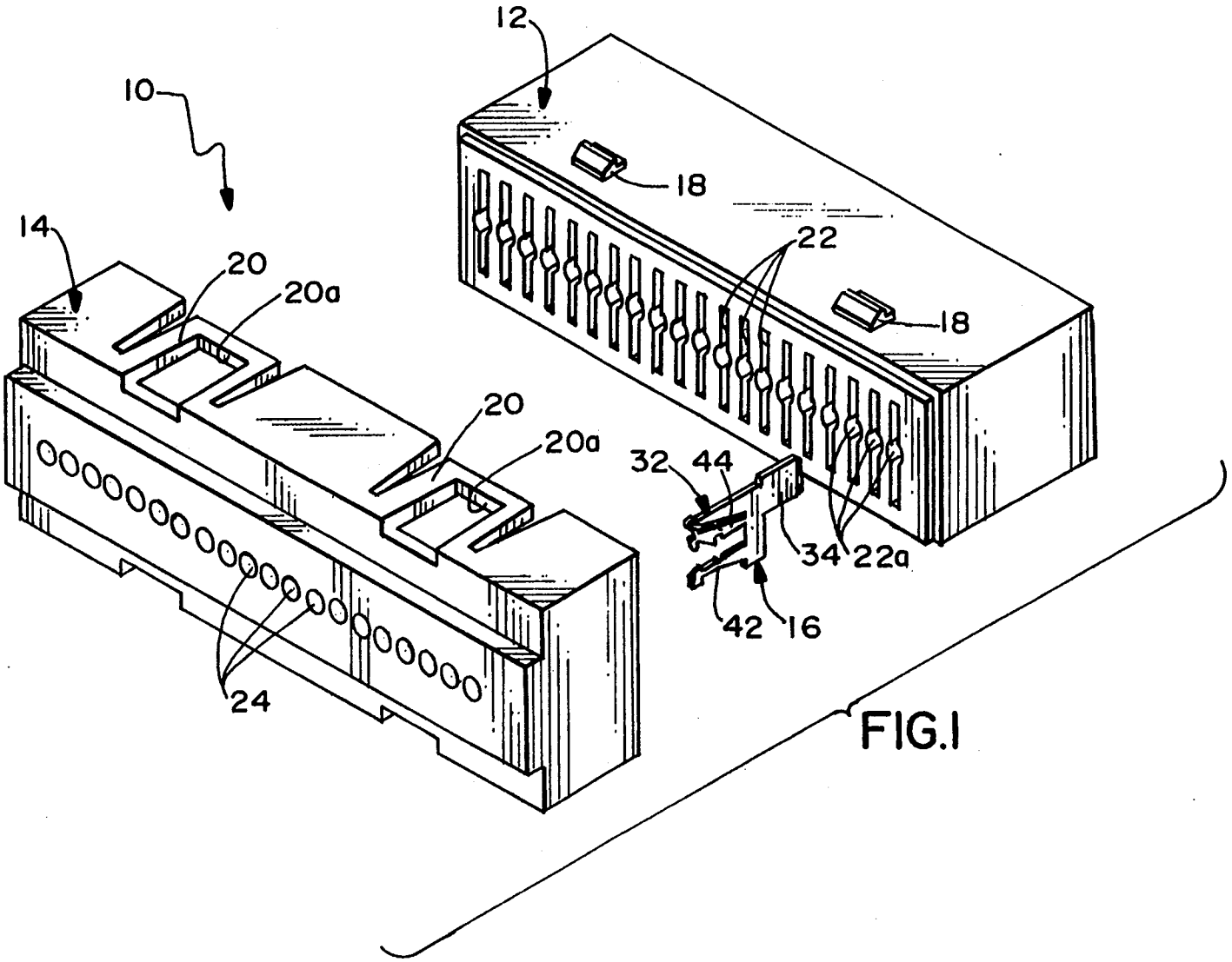
FIG. 1 is an exploded perspective view of one embodiment of an electrical connector incorporating the flat terminal of the invention, the connector including a two-part housing.

Referring to the drawings in greater detail, FIGS. 1–3A show an embodiment of an electrical connector incorporating a two-part housing, and FIGS. 4–7 show an embodiment of the invention incorporated in a one-piece connector housing. As will be fully described hereinafter, the primary difference between the two embodiments is that the two-part connector housing of FIGS. 1–3A is used to deform the insulation displacement terminal, whereas a terminating tool is used in the embodiment of FIGS. 4–7. Otherwise, the unique, deformable flat terminal of the invention is the same in both embodiments.

Referring to FIG. 1, an electrical connector, generally designated 10, is shown to include a two-part housing including a base part, generally designated 12, and a cover part, generally designated 14. Base part 12 mounts a plurality of terminals, generally designated 16, and cover part 14 is effective to engage the terminals and deform the terminals into insulation-displacing condition with respect to a plurality of insulated electrical wires, as will be described hereinafter.

More particularly, and still referring to FIG. 1, base part 12 of the two-part housing includes a pair of stepped latch bosses 18 on each opposite longitudinal side thereof. Cover part 14 includes a pair of U-shaped latch arms 20 on each longitudinal side thereof for latchingly engaging latch bosses 18. Each latch arm 20 has a latch shoulder **20*a* defined on the inside of the U-shaped configuration thereof. Generally, base part 12 has a row of terminal-receiving passageways 22 each adapted for receiving one of the terminals 16. Cover part 14 includes a plurality of wire-receiving passages 24 which are aligned with terminal-receiving passageways 22 when the two parts of the housing are engaged. In fact, as seen in FIG. 1, terminal-receiving passageways 22 have enlarged, rounded center areas 22*a* of a size similar to wire-receiving passages 24**.

Figure 2:
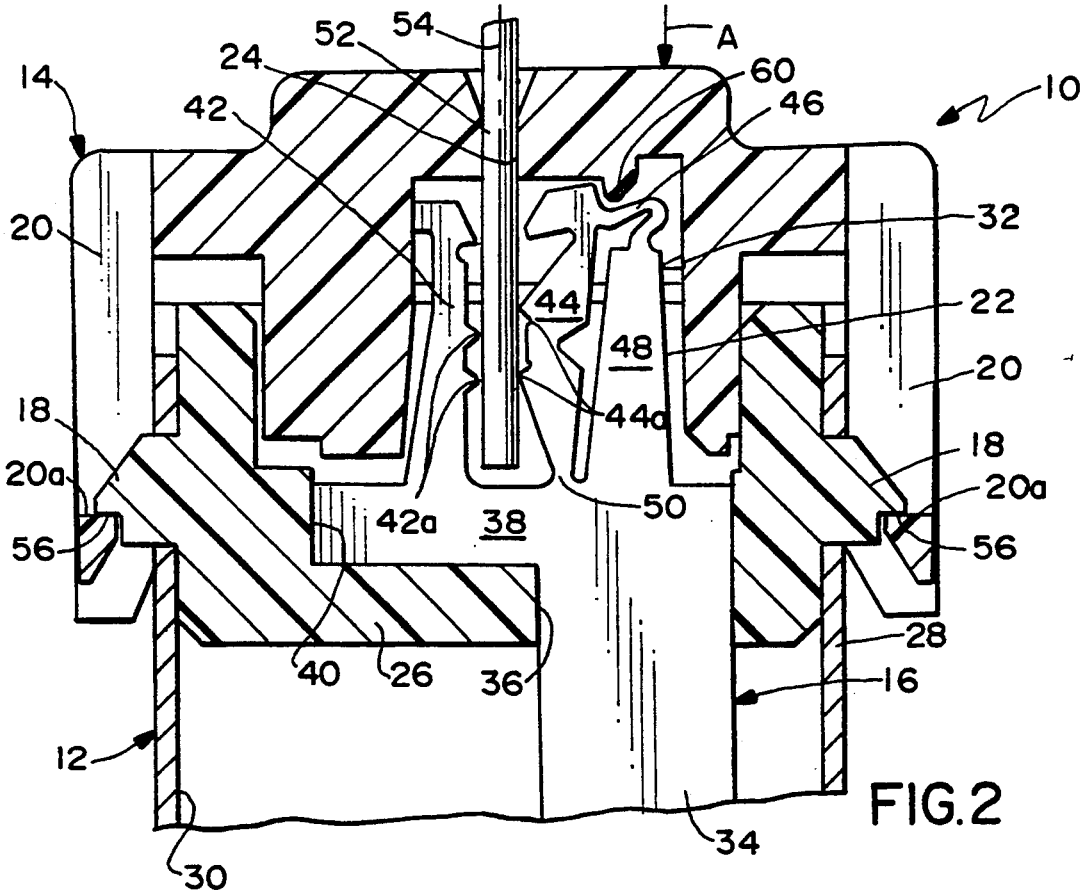
FIG. 2 is a fragmented vertical section through the connector of FIG. 1, with the two-part housing in a pre-terminating condition and accepting an insulated wire.
Figure 2A:
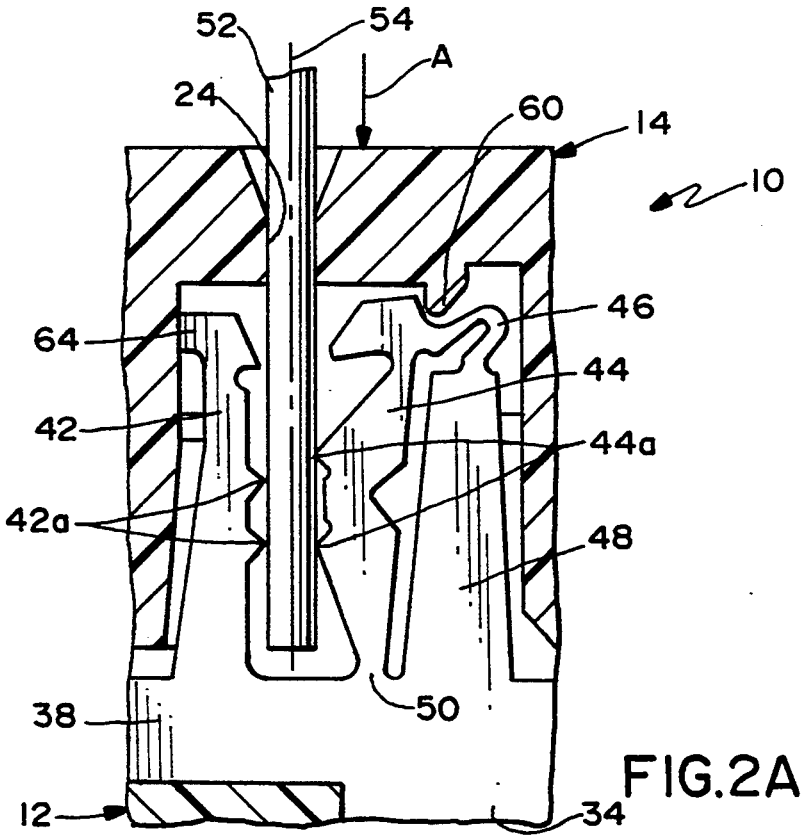
FIG. 2A is a fragmented enlargement of the terminating section area of the terminal and the electrical wire in FIG. 2.

Cover part 14 of the connector housing is unitarily molded of dielectric material such as plastic or the like. Therefore, latch arms 20 are resiliently flexible for snappingly engaging latch bosses 18. Referring to FIGS. 2 and 2A, base part 12 of the connector housing includes a unitarily molded plastic body 26 substantially surrounded by a shield 28 of conductive material, such as metal. The shield defines a mating cavity 30 for receiving a complementary electrical connector, as described hereinafter.

Referring to FIGS. 2 and 2A in conjunction with FIG. 1, each terminal 16 includes a terminating section, generally designated 32, and a blade section 34 which projects through a hole 36 (FIG. 2) in body 26 and into mating cavity 30 within shield 28. The terminal blade forms a male contact for engaging a female contact portion of a terminal in the mating connector which is inserted into cavity 30. The terminal further includes an intermediate body section 38 press-fit into an enlarged area 40 of each terminal-receiving passageway 22 in body 26 of the base part of the connector housing.

Terminating section 32 of each terminal 16 includes a fixed portion 42 and a deflectable portion 44 which, in turn, is connected by a deformable web to a rigid portion 48 solidly joined to body portion 38. Deflectable portion 44 is joined to body portion 38 by a narrow deformable neck area 50. Lastly, each of fixed portion 42 and deflectable portion 44 include teeth **42*a* and 44*a*, respectively, for piercing and, therefore, displacing the insulation of an electrical wire 52 which defines a longitudinal axis 54** thereof.

FIGS. 2 and 2A show electrical connector 10 in a pre-terminating condition wherein cover part 14 of the two-part connector housing has its latch arms 20 snappingly engaging a first step 56 of each latch boss 18. In this condition, electrical wire 52 is readily inserted through a respective wire-receiving passage 24 in cover part 14 in the direction of arrow "A" and to a position between fixed portion 42 and deflectable portion 44 of terminating section 32 of the respective terminal 16.

Figure 3:
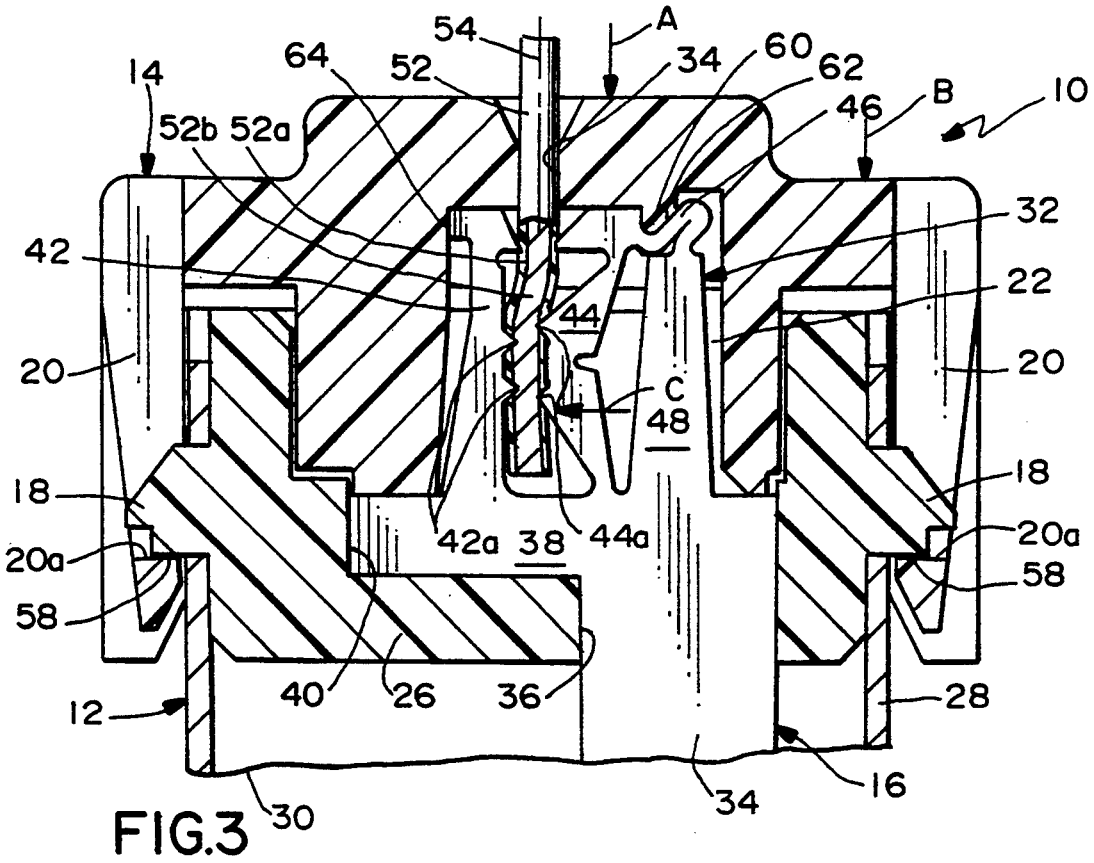
FIG. 3 is a view similar to that of FIG. 2, but with the two-part housing in terminating condition and the terminal in insulation displacement condition.
Figure 3A:
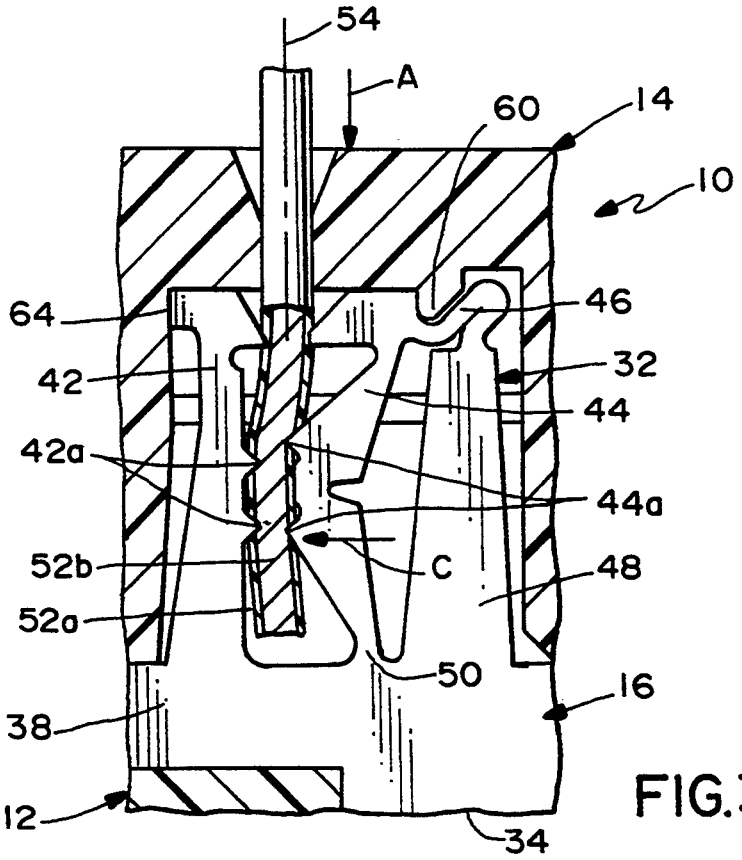
FIG. 3A is a fragmented enlargement of the area of the terminating section in FIG. 3.

Now, referring to FIGS. 3 and 3A, cover part 14 of the two-part connector housing is shown having been moved in the direction of arrow "B", whereby latch shoulders **20*a* of latch arms 20 have engaged second steps 58 of latch bosses 18. In addition, a deflecting boss 60 on the inside of cover part 14 has engaged within a recess 62 adjacent deformable web 46 of terminating section 32 of terminal 16. It should be noted that fixed portion 42 of the terminating section rigidly abuts the inside of cover part 14, as at 64. Therefore, fixed portion 42 remains stationary or fixed at all times during termination. However, deflectable portion 44 can be seen deflected in the direction of arrow "C" toward fixed portion 42, as the terminating section of the terminal deforms at deformable web 46 and neck area 50. It also can be seen that teeth 44*a* of deflectable portion 44 have been driven through insulation 52*a* of insulated wire 52 and into contact with a conductor or core 52*b* of the wire. Teeth 42*a* of fixed portion 42** also have been driven through the insulation into contact with the conductor.

It should be understood that, although cover part 14 is shown in FIGS. 3 and 3A in a latched condition with respect to base part 12 of the connector housing, with terminating section 32 in its deformed condition, the cover part is not necessary to maintain the deformed or insulation-displacing condition of the terminal. That is because the terminal is stamped in a flat configuration and is disposed within the connector in a plane coincident with longitudinal axis 54 of insulated wire 52. In other words, deformable web 46 and neck area 50 deform in a direction coplanar with the plane of the metal material which forms the terminal or at least the terminating section thereof. This is in contrast to deflecting the metal material transverse to its plane which would result in a resilient or "spring-back" condition. By deflecting the terminal in its plane, the deflected portions (i.e. deformable web 46 and neck area 50) will be permanently deformed.

Figure 4:
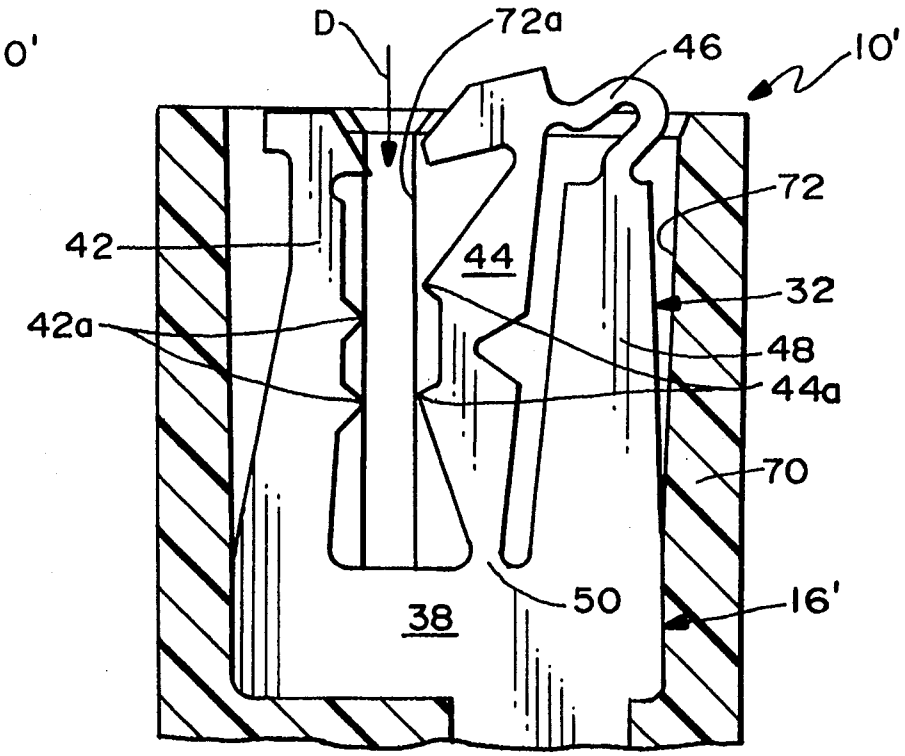
FIG. 4 is a fragmented section of an alternate embodiment of a connector incorporating a one-piece housing.

FIGS. 4–7 show an alternate embodiment of the invention wherein an electrical connector, generally designated 10', is shown to include a one-part housing 70 having a plurality of terminal-receiving passageways 72 with enlarged areas **72*a* for receiving an insulated wire 52 in the direction of arrow "D" (FIG. 4). Only one passageway 72 is shown in the drawings for receiving a respective one of terminals 16' which is very similarly configured to terminal 16 in FIGS. 1–3A. Therefore, like numerals have been applied to like components or portions of terminal 16' corresponding to similar portions of terminal 16** described above.

Figure 5:
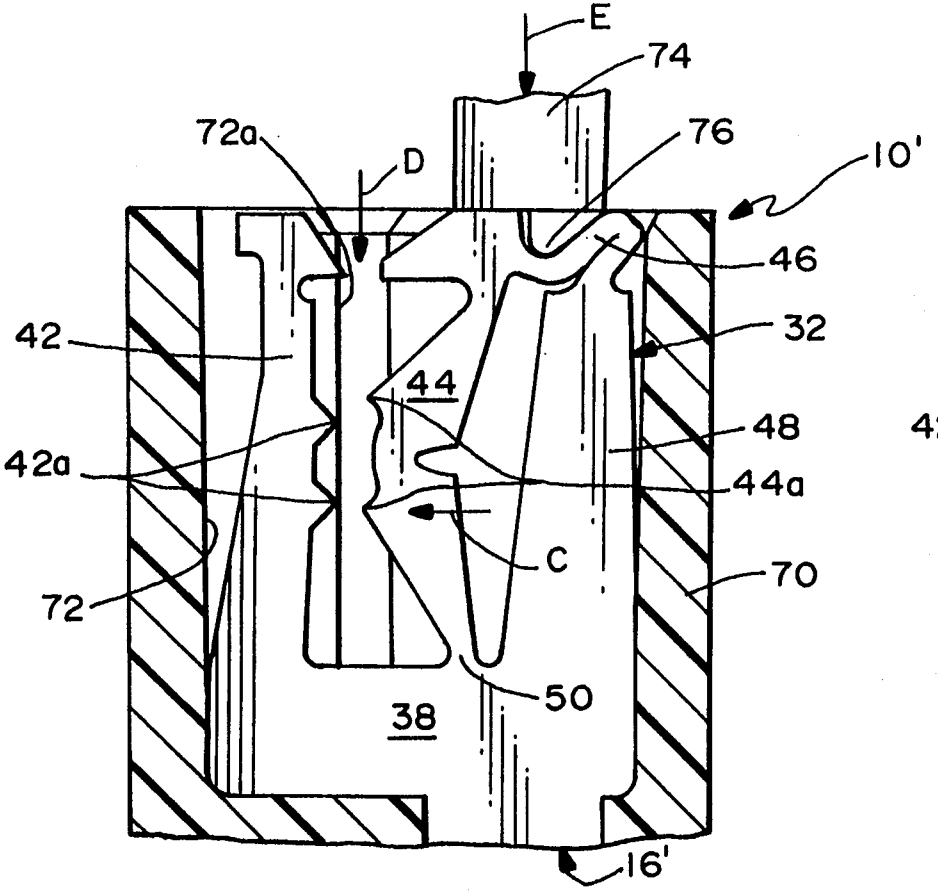
FIG. 5 is a view similar to that of FIG. 4, but with a terminating tool deforming the terminating section of the terminal.

In the one-part housing connector 10' of FIGS. 4–7, there is no cover part for effecting insulation displacement termination between terminal 16' and insulated wire 52. Therefore, FIG. 5 shows a terminating tool 74 having a distal end provided with a deflecting boss 76 which corresponds to deflecting boss 60 inside cover part 14 as described above. FIG. 4 shows insulation displacement section 32 of terminal 16' in an unstressed or non-terminating condition. FIG. 5 shows tool 74 having been forced downwardly in the direction of arrow "E" to deform terminating section 32 at deformable web 46 and neck area 50, as described above, to drive deflecting portion 44 and its teeth **44*a*** in the direction of arrow "C".

Figure 6:
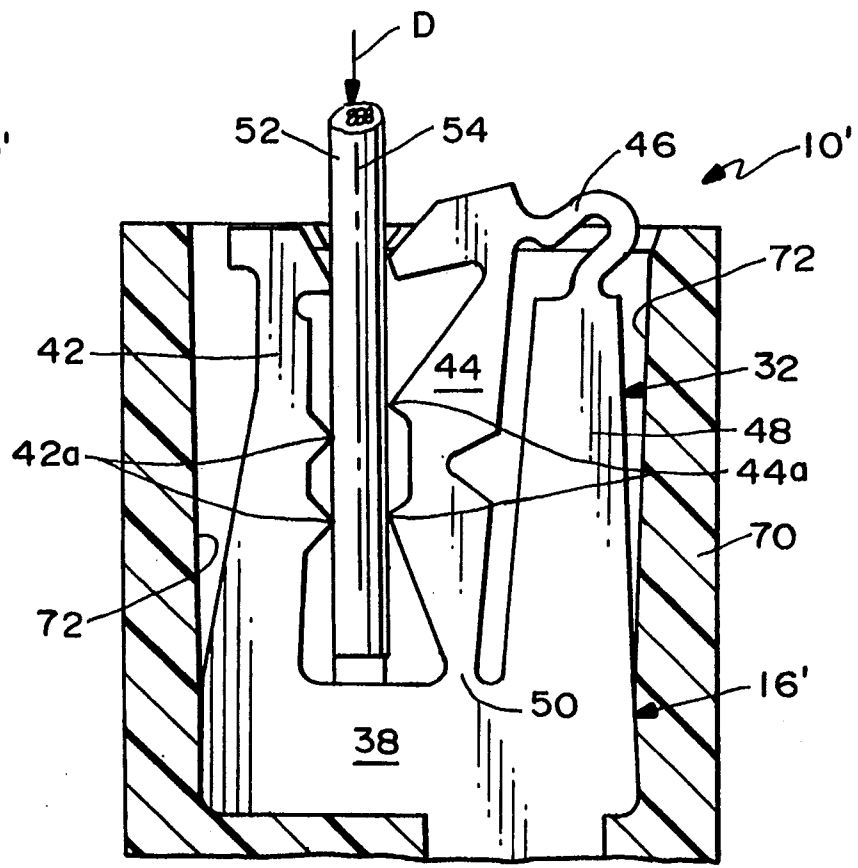
FIG. 6 is a view similar to that of FIG. 4, but with an insulated wire in position within the connector.
Figure 7:
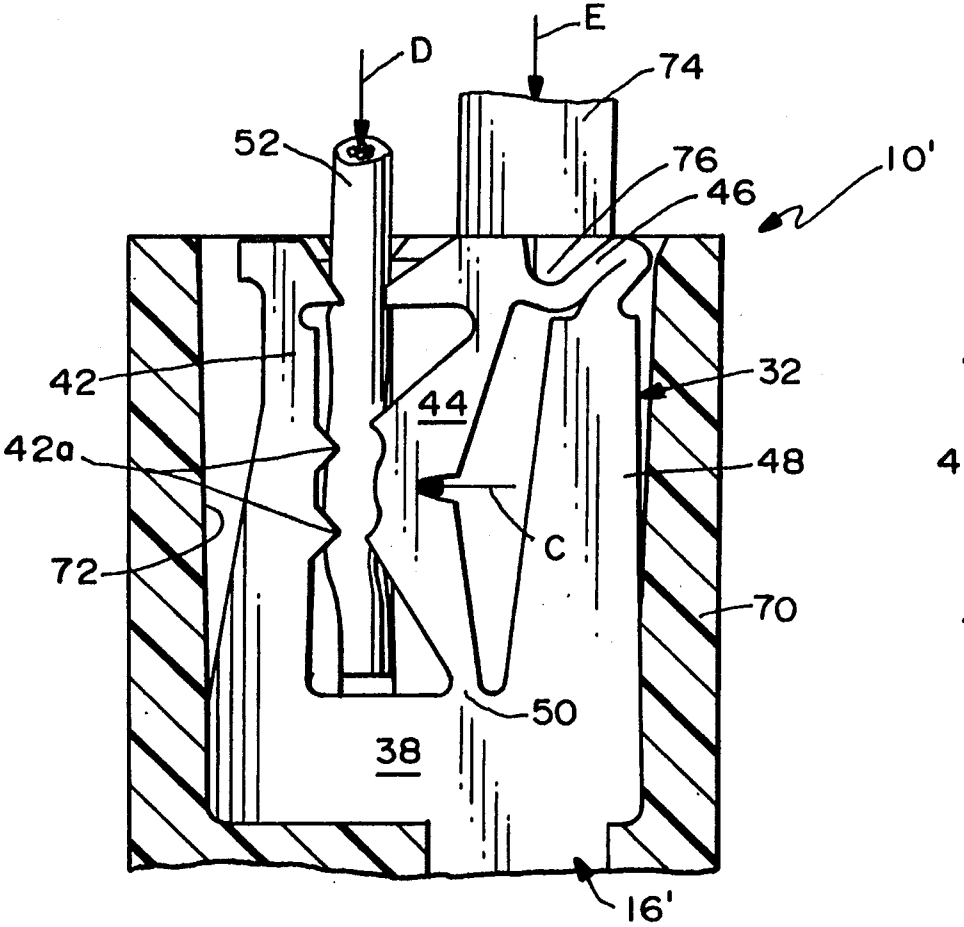
FIG. 7 is a view similar to that of FIG. 5, again with the insulated wire within the connector.

Lastly, FIGS. 6 and 7 are substantially identical to FIGS. 4 and 5, except that electrical wire 52 has been inserted between deflectable portion 44 and fixed portion 42 of terminating section 32 of the terminal to show the insulation displacement effect in connector 10' and how the action is substantially identical to that described above in relation to connector 10 in FIGS. 2–3A. It might be noted that fixed portion 42 is not rigidly backed by the housing in an area corresponding to area 64 in the embodiment illustrated in FIG. 3. However, the base of fixed portion 42 where it is joined to body portion 38 is much wider than either neck area 50 or deformable web 46 and, therefore, deflectable portion 44 will be moved while fixed portion 42 experiences little movement. When terminating tool 74 (FIG. 7) is removed, terminating section 32 (i.e. deformable web 46 and neck area 50) will maintain the deformed condition shown, with deflectable portion 44 of the terminal fully terminated to insulated wire 52.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector which includes a dielectric housing having a terminal-receiving passageway, an insulated displacement terminal received in the passageway and defining a mouth for accepting an insulated wire to be terminated, the wire including an electrical conductor with a sheath of insulation thereabout, the terminal including a terminating section which is generally flat in a plane coincident with the longitudinal axis of the insulated wire and comprises at least a rigid portion, an intermediate portion and a deflectable portion for displacing the insulation and engaging the conductor upon the application of a force on the terminal generally inwardly and parallel to the longitudinal axis, wherein the improvement comprises;

the deflectable portion is joined to the rigid portion through a deformable web and to the intermediate portion through a deformable neck area which are arranged and configured so as to move said deflectable portion substantially transversely to the longitudinal axis when said parallel force is applied to said deflectable portion.

2. The electrical connector as set forth in claim 1, wherein said deformable web is undulatory U-shaped with a recess facing outwardly, and said parallel force is applied onto said web through a deflecting boss entering said recess so that said web is deformed with a laterally expanding component.

3. The electrical connector as set forth in claim 1 or 2, wherein the terminating section of the terminal also includes a fixed portion facing said deflectable portion and defining said mouth therebetween for accepting the insulated wire.

4. The electrical connector as set forth in claim 3, wherein at least one of said fixed and deflectable portions includes insulation displacing teeth which are directed into said mouth.

5. The electrical connector as set forth in claim 1 or 2, wherein said dielectric housing is a two-part housing including a base part and a cover part, the base part mounting the terminal and the cover part engaging the deflectable portion in response to relative movement between the housing parts when said force is applied.

6. The electrical connector as set forth in claim 5, wherein said cover part includes a wire-receiving passage aligned with said terminal-receiving passageway.

7. An insulation displacement terminal for terminating an insulated wire having an electrical conductor with a sheath of insulation thereabout, comprising a terminating section which is generally flat in a plane coincident with the longitudinal axis of the insulated wire, and comprises at least a rigid portion, an intermediate portion and a deflectable portion facing a mouth for accepting the insulated wire, said deflectable portion displacing the insulation and engaging the conductor upon the application of a force on the terminal generally parallel to the longitudinal axis wherein the improvement comprises the deflectable portion is joined to the rigid portion through a deformable web and to the intermediate portion through a deformable neck area which are arranged and configured so as to move said deflectable portion substantially transversely to the longitudinal axis when said parallel force is applied to said deflectable portion.

8. The insulation displacement terminal of claim 7, wherein said deformable web is undulatory U-shaped with a recess facing outwardly, and said parallel force is applied onto said web through a deflecting boss entering said recess so that said web is deformed with a laterally expanding component.

9. The insulation displacement terminal of claim 7 or 8, wherein the terminating section of the terminal also includes a fixed portion facing said deflectable portion and defining said mouth therebetween for accepting the insulated wire.

10. The insulation displacement terminal of claim 9, wherein at least one of said fixed and deflectable portions include insulation displacing teeth which are directed into said mouth.

* * * * *